US005598664A

United States Patent [19]

Grice

[11] Patent Number: 5,598,664

[45] Date of Patent: Feb. 4, 1997

[54] SLIDING PARTITION CONTAINING ROTATABLE LOUVRES

[75] Inventor: Neil E. Grice, Indooroopilly, Australia

[73] Assignee: Verosol (Australia) Pty Limited, Belmont, Australia

[21] Appl. No.: 341,618

[22] PCT Filed: Sep. 6, 1993

[86] PCT No.: PCT/AU93/00451

§ 371 Date: Nov. 17, 1994

§ 102(e) Date: Nov. 17, 1994

[87] PCT Pub. No.: WO94/05889

PCT Pub. Date: Mar. 17, 1994

[30] Foreign Application Priority Data

Sep. 8, 1992 [AU] Australia ..... PL4537

[51] Int. Cl.[6] ..... E06B 7/08

[52] U.S. Cl. ..... 49/74.1; 49/82.1

[58] Field of Search ..... 49/74.1, 87.1, 49/82.1, 460; 160/84.07; 454/221, 224, 278; 16/112

[56] References Cited

U.S. PATENT DOCUMENTS

| | | | |
|---|---|---|---|
| 361,019 | 4/1887 | Morstatt | 49/82.1 |
| 2,166,441 | 7/1939 | Jones | 49/82.1 |
| 3,680,470 | 8/1972 | Neece | 49/82.1 X |
| 4,655,003 | 4/1987 | Henley | 49/74.1 X |

*Primary Examiner*—Kenneth J. Dorner
*Assistant Examiner*—Jerry Redman
*Attorney, Agent, or Firm*—Robbins, Berliner & Carson, LLP

[57] ABSTRACT

A partition assembly comprises a number of louver blades which can be opened and closed by activating means in the form of a push rod which is concealed with the partition.

10 Claims, 3 Drawing Sheets

SLIDING PARTITION CONTAINING ROTATABLE LOUVRES

FIELD OF THE INVENTION

THIS INVENTION relates to a sliding partition (such as a sliding door or window) containing rotatable louvres and especially relates to a sliding partition which is compact in design and which can slide from an open to a closed position irrespective of whether the louvres are in an open or closed position.

BACKGROUND ART

Sliding partitions such as sliding doors or windows are typically mounted in a lower and/or upper track. The track is generally of a U shaped channel section to guide the sliding partition between its open and closed positions.

One type of sliding door arrangement has the door sliding into a cavity wall when moved to its open position. Another type of sliding door assembly has the door sliding past a wall when moving to its open position. A yet further type of sliding door assembly has the sliding door sliding past a fixed door or window when moved between its open and closed positions.

In each of the above constructions, there is a requirement to ensure that the door can properly slide without striking the walls of the cavity, the fixed wall or the fixed door or window as the case may be. There is a further requirement to ensure that the entire assembly is as compact as possible. For instance, cavities of large width are difficult to make and result in loss of available living space in a room. For doors sliding past a wall or a fixed door or windows, it is generally undesirable to have the track spaced too far from the wall as this looks unsightly and in the case of upper tracks is difficult to support.

In the situation of two doors which can slide relative to each other, such an assembly requires a channel divided into two longitudinal tracks with each door sliding in a respective track. Again, it is a requirement that the doors do not strike each other when being moved.

Sliding partitions (such as sliding doors) containing rotatable louvres are also known. The louvres are mounted more or less in the conventional manner (i.e. pivotally mounted to a surround frame) and can be rotated by an actuating mechanism. Examples of louvre assemblies are illustrated in Australian Patent Applications 50979/79, 68212/81, 80610/82, 33573/84 and variations are illustrated in 68756/81 and 10847/83.

In each of these illustrated examples, the louvres when moved to an open position, have portions which jut from the surround frame. These portions can either include the louvre blades themselves or a handle or like member.

Clearly, if such arrangements are mounted to a sliding door, such a door cannot be slid to an open position when the louvres are in their open positions without the louvres striking and being damaged by the fixed wall, fixed door or window or the walls of a cavity.

However, there is a considerable demand for louvre doors having rotatable louvres (as opposed to fixed louvres) especially in the tropical or semi-tropical areas. The rotating louvres provide a degree of privacy and protection against weather.

DISCLOSURE OF THE INVENTION

After considerable research and experimentation, we have now developed a sliding partition containing rotatable louvres which is of a compact design and which, when the louvres are in their open position, does not include any projecting portion which can interfere with an adjacent sliding door. Thus, our sliding partition can be mounted more or less in a track which has hitherto been suitable only for sliding doors having fixed louvres or no louvres at all.

We can achieve this by a particular louvre pivoting arrangement and a particular placement and connection of the actuator which rotates the louvres.

Therefore, in one form, the invention resides in a partition assembly comprising a plurality of parallel longitudinally extending louvre blades, the blades having longitudinal side edges and transverse end edges, the transverse end edges being pivotally connected to a support to allow the louvres to exhibit rotation, and actuating means to rotate the louvre blades, the actuating means being disposed adjacent one transverse edge of the louvre blades and being pivotally coupled to the transverse edge.

The partition may comprise a sliding door or sliding window. We prefer the sliding partition to comprise a sliding shutter door.

The partition may comprise the louvres located within a surround frame. The louvres may comprise substantially the entire partition and may be located within a pair of vertically extending side frame members and a pair of horizontally extending top and bottom frame members. Typically, the support comprises one of the side frame members.

The louvre blades may extend horizontally and/or vertically although it is preferred that the blades extend horizontally.

The louvre blades may be manufactured from any number of suitable materials and these may include wood, plastic, metal, glass or combinations thereof. For sliding shutter doors having aesthetic appearance, it is preferred that the louvre blades and the remaining portion of the sliding partition are manufactured from wood.

The partition may slide within a track. The track suitably comprises a channel member along which the sliding door may move. The channel member may be divided into two longitudinal separate tracks thereby allowing a pair of sliding doors to be fitted. The track may be of any particular width but typically may be between 30 to 100 mm with a preferred width being approximately 40 mm.

It is preferred that the louvre blades are of a dimension such that when in the open position they do not exceed the track width. Under these circumstances, a pair of sliding partitions may slide past each other without striking.

The actuating means may comprise an elongate rod, bar, plate or like member. The actuating means may be pivotally coupled to a respective transverse end of each louvre blade and preferably adjacent the juncture of the transverse end and the side edge. The actuating means may be located within a rebate or recessed portion in the support and suitably does not extend from the support, or track when the louvre blades are in any desired position.

The actuating means may be provided with a handle which can be gripped. The handle may be of a folding or hinging type to be movable between an outwardly extending use position and a folded substantially flush non-use position.

BRIEF DESCRIPTION OF THE DRAWINGS

The invention will be illustrated with reference to the accompanying drawings in which—

BEST MODE

Figure 1:
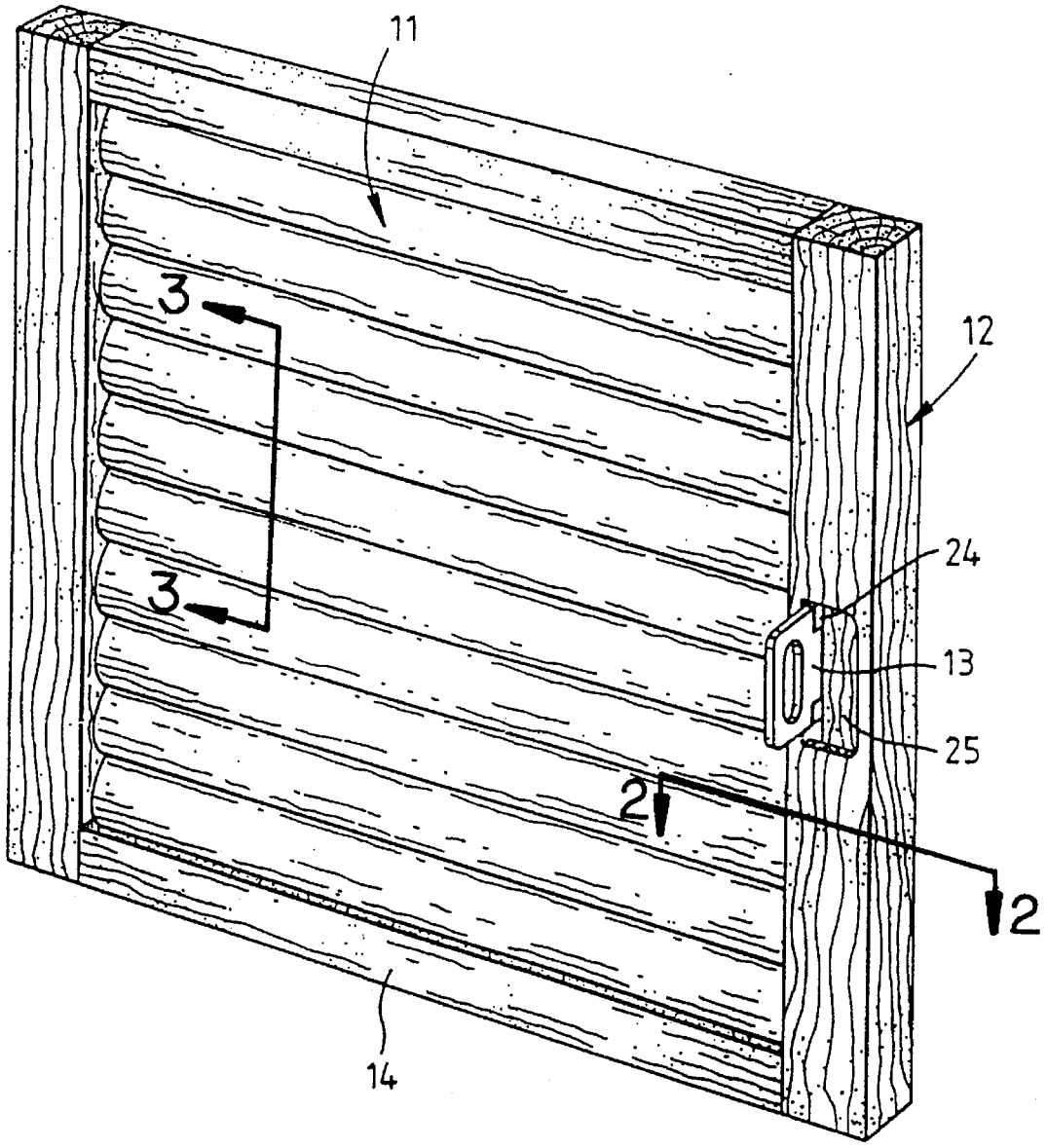
FIG. 1 is an perspective view of a sliding partition according to an embodiment of the invention.

Referring to the figures and especially FIG. 1 there is illustrated a partition. The partition is in the form of a sliding wooden shutter door and includes a plurality of horizontal louvre blades 11 which are supported by a support 12 in the form of a vertically extending wooden door stile. The actuating mechanism of the louvre blades 11 is concealed and therefore the shutter door itself has a pleasant and attractive appearance and finish. A handle 13 is provided to enable the louvres to move between the open and closed positions and the operation of handle 13 will be described in greater detail with reference to the other figures.

Figure 2A:
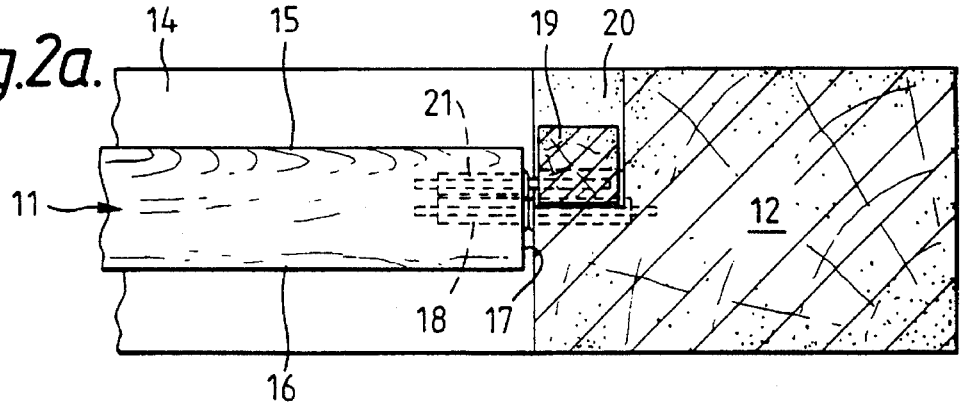
FIG. 2*a* and 2*b* are plan section views of the partition of FIG. 1 along the line 2—2 showing the louvre blades in the closed and open positions respectively.
Figure 2B:
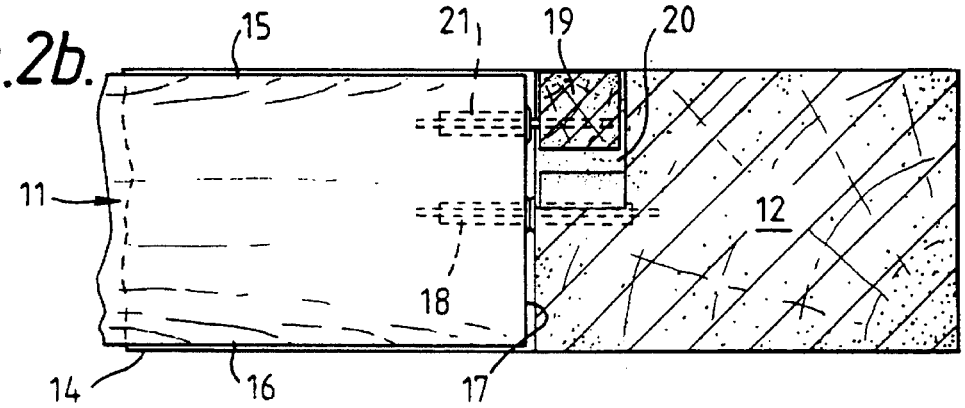

Referring to FIGS. 2*a* and 2*b*, there is disclosed the mechanism by which the louvre blades can be moved between the closed and open positions. FIG. 2*a* illustrates the vertically extending stile 12 in plan and also a horizontally extending bottom frame member 14. The width of frame member 14 is typically about 40 mm but this is by no means to be considered as a restriction on the scope of the invention.

Each louvre blade 11 includes a longitudinal side edge 15, 16 and a transverse end edge 17.

Transverse end edge 17 is pivotally mounted to door stile 12 through a first pivot pin 18 which extends through the centre of edge 17. In this manner, the louvre blade 11 can pivot about pivot pin 18 between its closed and open positions.

The louvre blades 11 are caused to move by an actuating means in the form of a push stick 19. Push stick 19 can comprise a longitudinal rod formed of any suitable material such as ply. Push stick 19 locates within a recessed or rebated portion 20 within door stile 12 as illustrated in FIGS. 2*a* and 2*b*.

Push stick 19 is pivotally connected to louvre blade 11 through pivot point 21. Pivot point 21 is located between pivot point 18 and a longitudinal side edge of louvre blade 11.

To manipulate the louvre blades, push stick 19 is moved upwardly or downwardly in door stile 12 which in turn causes rotation of the louvre blades.

Figure 4A:
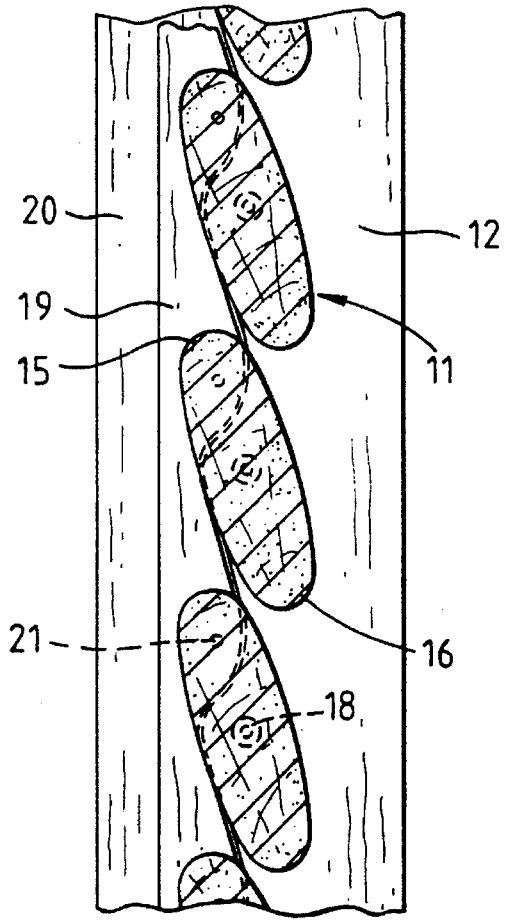
FIGS. 4*a* and 4*b* are side views along the line 4—4 of FIG. 1, showing the louvre blades in a closed and open position respectively.
Figure 4B:
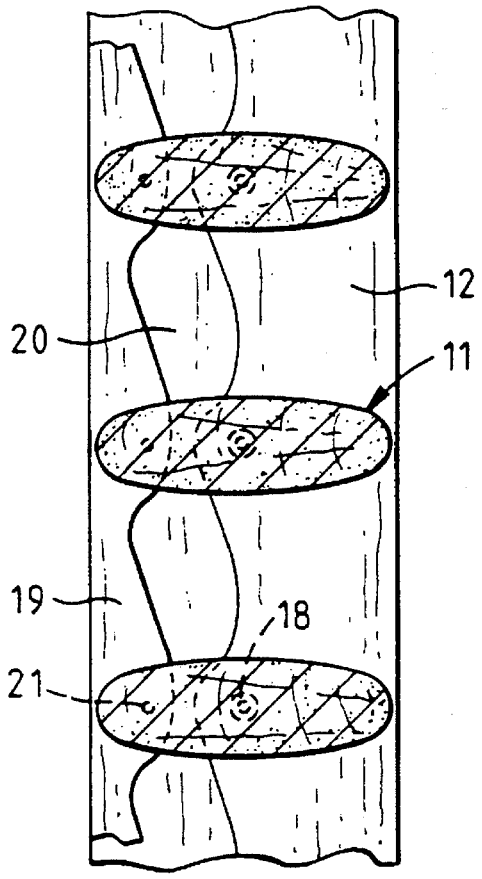

For the purposes of obtaining a compact yet strong design, it is preferred that the push stick is of an undulating design as illustrated in FIGS. 4*a* and 4*b*. The corresponding section of door stile 12 is of a complimentary undulating configuration such that when the louvres are in a closed position as illustrated in FIG. 4*a*, there is substantial mating between push stick 19 and door stile 12 and when the louvres are rotated to an open position as shown in FIG. 4*b*, push stick 19 is spaced from door stile 12. The reason for the undulating design is to provide greater strength around the respective pivot points 18 and 19 which may otherwise be difficult.

Figure 3:
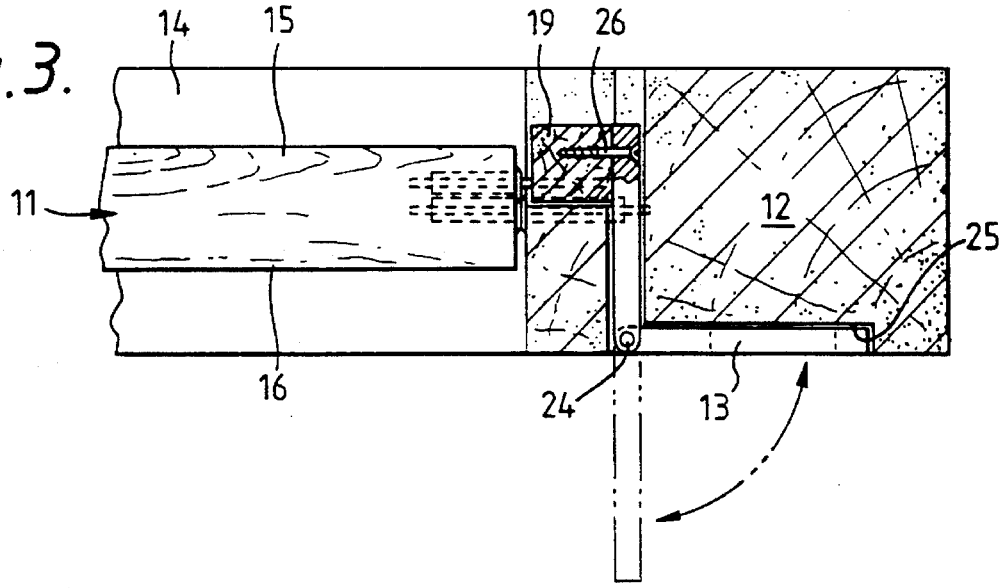
FIG. 3 is a further plan section view along the line 2—2 showing the arrangement of the handle.

FIG. 3 illustrates a handle. 13 (see also FIG. 1) which can be used to manipulate push stick 19. Handle 13 is foldable about a hinge 24 between an extended use position as shown in FIG. 1 and a folded non-use position. In the latter position, the handle sits within a recess 25 to provide the flush finish. Handle 13 is fitted to push stick 19 through a fastener such as screw 26 and it can be seen in FIG. 1 that to operate push stick 19, it is merely necessary to grip handle 13 (which can be provided with eyelets to facilitate the gripping process), and then can be pushed down to the lower part of recess 25 which in turn will rotate louvres 11 to an open position.

Louvres 11 are dimensioned to have a width not exceeding that of the width of stile 12 or bottom frame member 14 and the folding handle 13 also results in there being no portion of the shutter door which protrudes. Thus, this type of shutter door can be mounted to a track or rail and can be used as a normal glass or wooden door without fear of damage to the louvre blades 11 when the louvre blades are in an open position.

Should a pair of sliding doors be used, the doors can be slid past each other with minimal clearance thereby resulting in a good weather sealing.

It should be appreciated that changes and modifications may be made to the embodiment described without departing from the spirit and scope of the invention.

I claim:

1. A partition assembly comprising a plurality of parallel longitudinally extending louver blades, the louver blades being housed within a surround frame, the louver blades having longitudinal side edges and transverse end edges, the transverse end edges being pivotally connected to the surround frame to allow louvres to exhibit rotation, reciprocating actuating means to rotate the louvre blades, the reciprocating actuating means being disposed adjacent one transverse end edge of the louver blades and being pivotally coupled to the transverse end edge, the reciprocating actuating means located within a recessed portion in the surround frame, and a handle, the handle having a first portion attached to the actuating means and a second portion hingedly attached to the first portion and moveable between an extended position where the second portion can be pushed upwardly or downwardly to rotate the louver blades, and a folded position where the handle sits in a recess in the surround frame such that it does not protrude from the surround frame.

2. The assembly of claim 1 wherein the actuating means is a push rod.

3. The assembly of claim 2 wherein the push rod is connected to each louver blade.

4. The assembly of claim 3 wherein the surround frame comprises a top, bottom, and support side members.

5. The assembly of claim 4 wherein the louver blades do not extend beyond the surround frame when in open or closed position.

6. The assembly of claim 1 wherein the actuating means reciprocates along a rebate in the surround frame.

7. The assembly of claim 1 wherein a transverse end edge of the louver blades is pivotally connected to a support, the support comprising a side edge of the surround frame, and wherein the actuating means and the support have projections and recesses which mate when the louver blades are closed.

8. A partition assembly comprising a plurality of louver blades in a spaced side-by-side relationship, the louver blades being within a surround frame comprising top, bottom and side opposed frame members, the louver blades having longitudinal side edges and transverse end edges, the transverse end edges being pivotally connected to a support which comprises said opposed side frame members of the surround frame to allow the louver blades to rotate between open and closed positions; a reciprocating actuating means in the form of a push rod which sits within a rebate provided in one of the side frame members, the push rod being pivotally connected to the transverse end edge of each blade and adjacent a juncture of the transverse end edge and the longitudinal side edge, and a handle, the handle having a first portion attached to the actuating means and a second portion hingedly attached to the first portion and moveable between an extended position where the second portion can be pushed upwardly or downwardly to rotate the louvre blades, and a folded position where the handle sits in a recess in the surround frame such that it does not protrude from the surround frame, the support and actuating means having projections and recesses which mate when the louver blades adopt the closed position.

9. The assembly of claim 8 wherein the support and actuating means have an edge which is sinusoidal and where the longitudinal side edges and the transverse end edges mate together when the louver blades adopt the closed position.

10. The assembly of claim 9 wherein the support has semi-circular projections extending about a pivot point between the transverse end edge and the surround frame, and the actuating means has corresponding semi-circular recesses which mate with projections when the louver blades adopt the closed position.

* * * * *